United States Patent [19]

Huel

[11] Patent Number: 4,548,377

[45] Date of Patent: Oct. 22, 1985

[54] SIGN MOUNTING SYSTEM

[76] Inventor: Georges Huel, 65 Sherbrooke St. East, Montreal, Quebec, Canada, H2X 1C4

[21] Appl. No.: 589,467

[22] Filed: Mar. 14, 1984

[30] Foreign Application Priority Data

Apr. 26, 1983 [CA] Canada ..... 426736

[51] Int. Cl.[4] ..... E04G 3/00

[52] U.S. Cl. ..... 248/219.1; 40/607

[58] Field of Search ..... 248/219.1, 218.4, 219.4, 248/230, 231; 40/607, 612, 606

[56] References Cited

U.S. PATENT DOCUMENTS

| | | | |
|---|---|---|---|
| 1,477,232 | 12/1923 | Aid | 248/219.4 X |
| 2,070,407 | 2/1937 | Knauber | 40/607 |
| 2,383,881 | 8/1945 | Murphy | 40/607 |
| 2,596,582 | 5/1952 | Michel | 40/607 |
| 2,708,087 | 5/1955 | Blackstone | 248/230 X |
| 3,012,750 | 12/1961 | Schermerhorn | 248/231 |
| 3,925,939 | 12/1975 | Costruba | 248/243 X |
| 4,076,126 | 2/1978 | Gilmour | 248/219.4 X |

FOREIGN PATENT DOCUMENTS

| | | | |
|---|---|---|---|
| 2021390 | 12/1979 | United Kingdom | 248/219.4 |

*Primary Examiner*—J. Franklin Foss

*Attorney, Agent, or Firm*—Cushman, Darby & Cushman

[57] ABSTRACT

A system for mounting signs to posts comprising a bracket having a plurality of sides provided with a longitudinal slot in one of its sides, two post engaging projections on another of its sides and at least one opening transverse to the slot, also comprising a sign capable of being introduced in the slot having at least one opening which is in alignment with those in the bracket. The whole being adapted to be securely held to the post by a strap or straps which extend(s) through the recess(es) and tightly wrapped around the post so as to retain the sign and the bracket at the same time.

7 Claims, 6 Drawing Figures

SIGN MOUNTING SYSTEM

This invention relates to means for mounting signs and the like on a post or pole.

It has previously been proposed to mount a sign or the like on a post or pole by means of a bracket to which the sign is attached, and then attach the bracket to the post or pole by means of bolts, screws or similar fasteners.

However, when it becomes necessary to detach the sign, difficulties can arise when the fasteners are being released. For example, the fasteners may have rusted or otherwise deteriorated as a result of exposure to climatic conditions and thus damage to the bracket and/or sign board may result when the fasteners are being released. Furthermore, the removal of such fasteners even when they are in good condition can be time consuming.

It is a further disadvantage with known brackets that the sign board or the like is attached to the bracket by fasteners which are additional to the fasteners for attaching the bracket to a post or pole. Thus, the sign fasteners may also have deteriorated as a result of exposure to climatic conditions and difficulties similar to those indicated above can be experienced even when only the sign is to be changed.

It is therefore an object of the invention to provide a bracket for a sign or the like which is so constructed that the bracket fastener or fasteners also effect attachment of the sign to the bracket as well as fastening the bracket to a post or pole.

It is a further object of the invention to provide a bracket which may be produced as an extrusion as opposed to fabricating it from a multiplicity of separate pieces which are subsequently assembled together.

It is a further object of the present invention to provide a bracket which can be mounted on posts or poles of different diameter and cross-sectional shapes.

It is a still further object of the present invention to provide a bracket which can be used for signs of different size.

Figure 5:
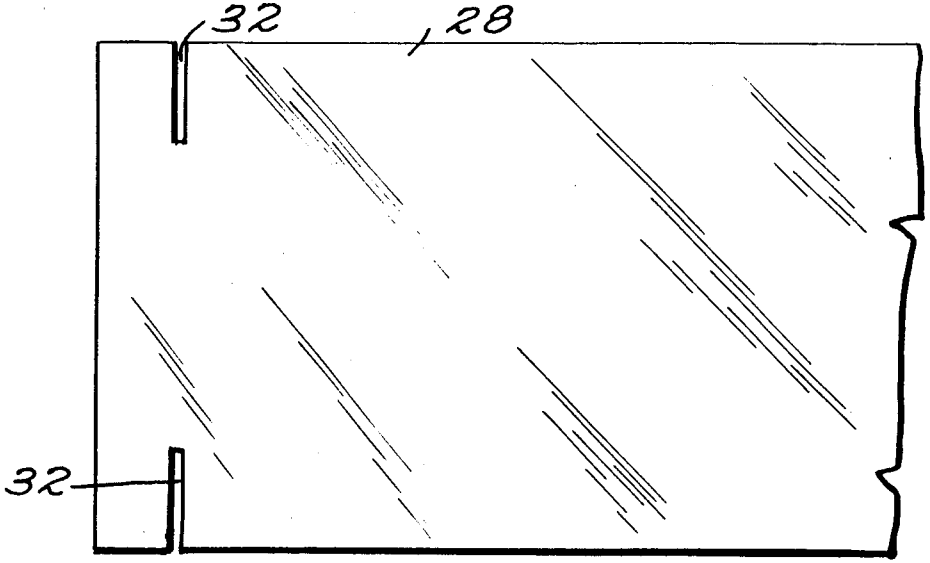
Figure 2:
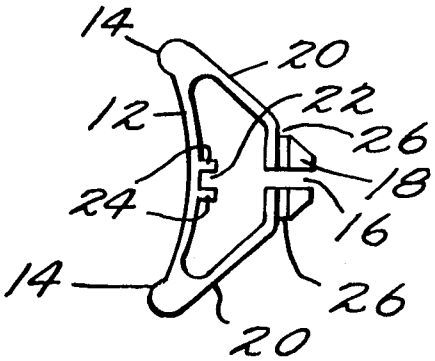
Figure 1:
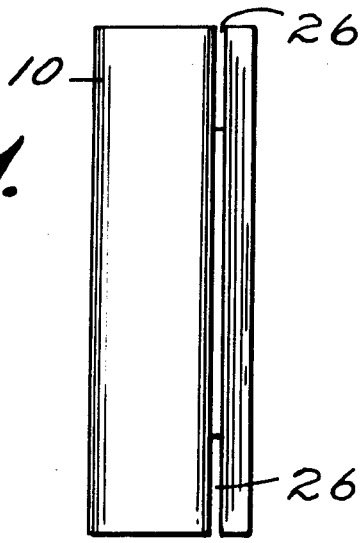
Figure 3:
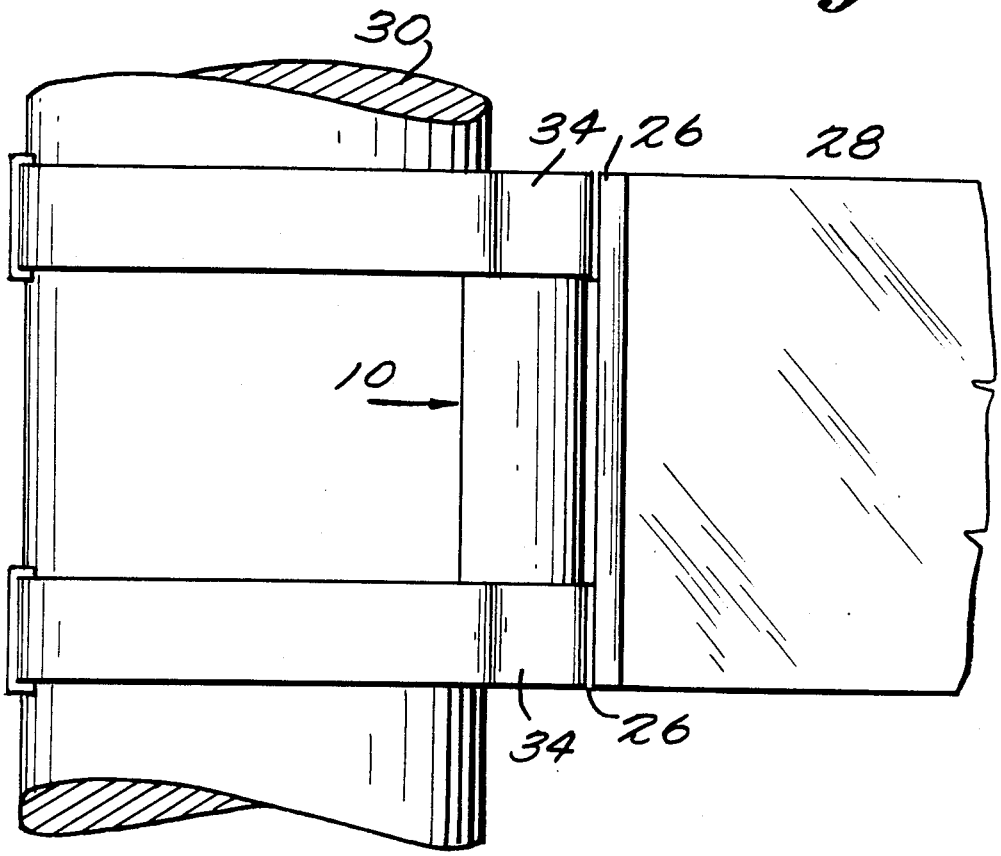
Figure 4:
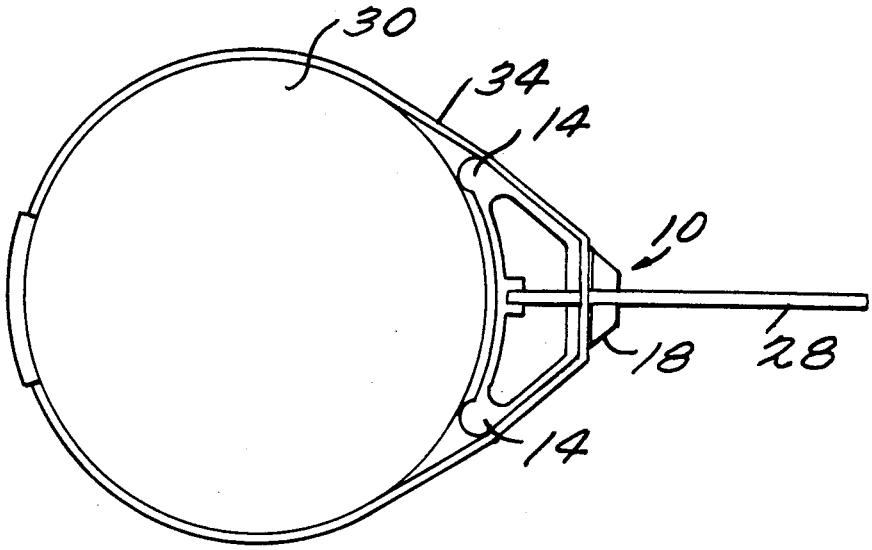
Figure 6:
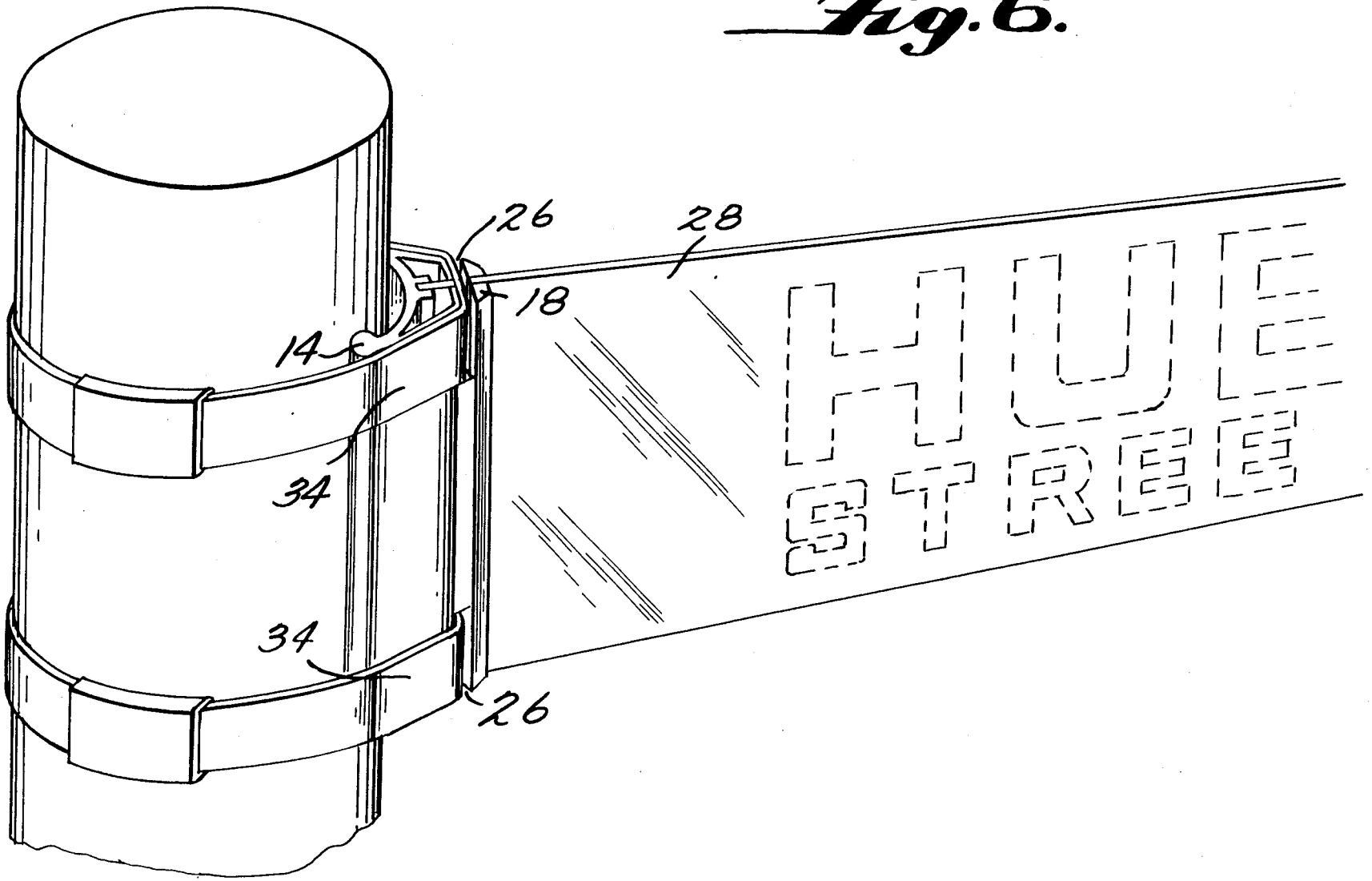

These and other objects will be apparent from the following description, with reference to the accompanying drawings, of a bracket in accordance with the invention, which is given by way of example only, in which, FIG. 1 is a side elevation of a bracket in accordance with the invention, FIG. 2 is an end view of the bracket shown in FIG. 1, FIG. 3 is a view showing the bracket mounted on a post or pole, FIG. 4 is a sectional plan view of the bracket shown in FIG. 3, FIG. 5 shows a sign board adapted for use with a bracket in accordance with the invention, and FIG. 6 is a perspective view of the assembled bracket and signboard shown in FIGS. 3 and 4 of the drawings.

Referring to the drawings 10 indicates a bracket in accordance with the invention which is generally triangular in cross-section and of hollow construction. The base 12 of the bracket 10 is concave in cross-section and each end is provided with a bulbous portion or projection 14 which projects beyond the base 12.

A slot 16 is provided in the apex 18 of the bracket 10 and extends over the full length of the bracket, whereby the sides 20 of the bracket can be flexed towards each other when external pressure is applied to them, as will be described later.

A recess 22, having at least the same width as the slot 16 in the apex 18, is provided on the inner surface of the base 12, and is parallel to and in line with the slot 16 as shown in FIGS. 2 and 4. The recess 22 is defined between two spaced apart projections 24 which are formed integrally with the base 12.

A slot or opening 26 is provided in each end of the bracket 10, as shown in FIGS. 1, 2 and 4, and extends transversely of the slot 16, to permit the use of a fastening strap at each end of the bracket.

When the above described bracket 10 is to be used to support a signboard 28 on a post 30 as shown in FIGS. 3 and 4, the signboard is provided with openings 32 along one of its edges as shown in FIG. 5. The height of the signboard 28 need not be equal to the length of bracket 10, provided the upper and lower edges extend over a substantial length of the associated slot 32.

However, the openings 32 must be so positioned as to be aligned with the slots or openings 26 in the bracket 10, when the signboard is mounted in the bracket 10 as shown in FIGS. 3 and 4 of the drawings. The thickness of the signboard 28 is preferably slightly smaller than the width of slot 16.

When the openings 32 have been formed in the signboard 28 and it has been inserted into the bracket 10 as described above, the assembled bracket and signboard are placed in the desired position on the post or pole 30 with the projections 14 in engagement with the pole or post 30.

A flexible metallic strap 34 is then passed through each opening 26 and wrapped around the post or pole 30. It will be seen that since the openings 32 in the signboard 28 are aligned with the openings 26 in the bracket 10, the straps 34 will also extend through the openings 32.

The ends of the straps 34 are then drawn together, by known means not shown, to securely retain the bracket on the pole or post, and the ends are then fastened together by known means not shown. Whilst the straps 34 are being tightened around the post or pole, the sides 20 of the bracket are preferably drawn towards each other, whereby the signboard will be gripped by those parts of the sides 20 defining the slot 16 and be securely retained in the bracket. Furthermore, if recess 22 has the same width as slot 16, the signboard will also be gripped by projections 24.

Thus, when it becomes necessary to remove or change the signboard, it is only necessary to cut the straps 34 and the bracket 10 and the signboard 28 are readily detached without damage to either the bracket, the signboard or the post or pole.

A bracket in accordance with the invention is preferably produced as an extrusion, whereby it can subsequently be cut into the required lengths and then provided with the transverse slots. It may be preferable to produce such an extrusion with a small bridge across slot 16 and to subsequently remove the bridge with a circular saw or other means in order to produce an extrusion having a slot of uniform width.

It will also be appreciated that the size of the bracket and the shape and size of the base can be varied according to the size of the signboard and the shape and size of the post or pole upon which the bracket is to be used.

The above described bracket may be extruded, constructed or fabricated from a metal such as aluminium, one of the plastics or any other suitable material.

Although only a particular embodiment of the invention has been described, it is also useful in other embodiments. For example, the bracket need not be hollow and its cross section need not be triangular. However the configuration of the cross section should preferably be such that the sides defining the longitudinal slot be drawn towards each other when the strap(s) is (are) tightened.

The embodiments of the invention in which an exclusive property or privilege is claimed are defined as follows:

1. A bracket for supporting a sign on a post, the bracket comprising:

an elongated body having a generally concavely curved base for engaging the post, two spaced side walls each extending from an opposite side of said base towards one another and having opposed, free edges spaced apart to define a slot means for receiving a portion of a sign, said free edges each having means for receiving a strap such that the strap will extend about the post over said side walls and across a portion of said slot means to retain a sign in place with one end thereof in said slot means when said bracket and sign are mounted on a post by the strap.

2. The invention as claimed in claim 1 wherein at least one strap is provided for extending around a post and through said means for receiving a strap in said bracket.

3. The invention as claimed in claim 2 wherein another strap is provided and said bracket includes a pair of means each for receiving a strap for extending around a post and over said spaced side walls so as to exert a pressure on said side walls to urge said free edges towards said slot means and against a sign disposed in said slot means.

4. The invention as claimed in claim 1 wherein a signboard is provided in the form of a sheet with said sheet having through slots formed therein for receiving a strap adjacent one edge thereof.

5. The bracket as claimed in claim 4 wherein said signboard has opposite edges with said one slot formed extending from one of said edges and another slot formed to extend from an opposite edge of said signboard.

6. The bracket as claimed in claim 1 wherein said base includes two post engaging projections on opposite sides of said base.

7. The bracket as claimed in claim 1 wherein said base includes an interior wall, said interior wall having recess defining means thereon for receiving the end of a signboard.

* * * * *